US006525668B1

(12) United States Patent
Petrick

(10) Patent No.: US 6,525,668 B1
(45) Date of Patent: Feb. 25, 2003

(54) LED ARRAY WARNING LIGHT SYSTEM

(75) Inventor: John T. Petrick, New Port Richey, FL (US)

(73) Assignee: TWR Lighting, Inc., Houston, TX (US)

( * ) Notice: Subject to any disclaimer, the term of this patent is extended or adjusted under 35 U.S.C. 154(b) by 0 days.

(21) Appl. No.: 09/973,906

(22) Filed: Oct. 10, 2001

(51) Int. Cl.[7] ..... G08B 5/22

(52) U.S. Cl. ..... 340/815.45; 340/473; 340/953; 362/800

(58) Field of Search ..... 340/815.45, 815.4, 340/473, 908.1, 982, 953; 362/800, 249, 80

(56) References Cited

U.S. PATENT DOCUMENTS 4,870,547 A * 9/1989 Crucefix ..... 362/123
5,440,459 A * 8/1995 Chan ..... 362/96
D363,685 S * 10/1995 Miller ..... D11/130.1
5,567,036 A * 10/1996 Thebald ..... 362/80
5,806,965 A * 9/1998 Deese ..... 362/249
6,244,728 B1 * 6/2001 Cote ..... 362/249

* cited by examiner

*Primary Examiner*—Anh La

(57) ABSTRACT

An LED array warning light system comprises a plurality of struts in a generally conical configuration. Each strut has an upper and lower edge and an inner and an outer edge. A plurality of light emitting diodes are affixed one above the other to an edge of each strut. A top disk with radial slots receives and is affixed to an upper edge of an associated strut. A bottom disk has radial slots which receive and are affixed to a lower edge of an associated strut. The disks are sized whereby the LED's are at an angle of between 3 and 25 from the axis.

9 Claims, 8 Drawing Sheets

LED ARRAY WARNING LIGHT SYSTEM

BACKGROUND OF THE INVENTION

1. Field of the Invention

The present invention relates to an LED array warning light system and more particularly pertains to rendering towers, cables and tall buildings visible to approaching aircraft.

2. Description of the Prior Art

The use of lighting systems of known designs and configurations is known in the prior art. More specifically, lighting systems of known designs and configurations previously devised and utilized for the purpose of illuminating tall structures rendering them visible to aircraft are known to consist basically of familiar, expected, and obvious structural configurations, notwithstanding the myriad of designs encompassed by the crowded prior art which has been developed for the fulfillment of countless objectives and requirements.

Various firms including TWR Lighting, Inc manufacture conventional L810 lights using incandescent lamps and tensed domes.

Dialight Corp. (http://www.dialight.com) has a Light Emitting Diode (LED) based L810 light on the market. This light uses an LED array, a single or dual Fresnel lens composed of heavy glass, and a lenticular array to provide the requisite beam azimuthal spread. The elevational directivity of the beam is established by the height relationship of the LEDs to the lens focal ring. The LED array used comprises 16 specialty LEDs affixed to a centrally disposed aluminum chimney-like structure for heat dissipation. The cost of the Dialight product is at least double the projected cost of the subject invention which uses readily available LEDs and conventional printed circuit board materials and does not require a special lensed dome.

The FAA requires that obstructions to aircraft, such as towers, cables, and tall buildings be fitted with visible elements to render these highly visible to approaching aircraft. FAA Advisory Circular AC-150/5345-43E forms the specification for these lights. Of these elements there exists a requirement for a low intensity steady burn red light system, designated the L810, to be placed in accordance with a set plan at levels on all towers potentially forming a hazard to air navigation. The L810 system generally incorporates a light source and a lensed dome directing red light into a 360 azimuth around the obstruction and within a band 10 degrees wide about a plane anywhere from 4 to 20 degrees above the horizontal. The minimum intensity of the L810 light is 32.5 candela. The conventional L810 employs an incandescent lamp appearing in bulb form having a long circular filament and a threaded base. The lensed dome comprises a red filter glass structure having a molded Fresnel outer portion and a lenticular array inner portion. The substantially white light produced by the filament is focused vertically into the 10-degree zone by the Fresnel portion and dispersed uniformly into the 360-degree zone by the lenticular array portion.

There are some LED based obstruction lights on the market, however all of these employ a Fresnel lens and internal lenticular array to product the requisite beam characteristics. Also, there is a requirement for a 2,000-candela flashing light designated the L864 light which is now generally satisfied with a xenon gas discharge lamp, however, an LED based L864 equivalent is available overseas, however the US version is in approval testing.

There is a need to simplify the optical systems of LED based aircraft obstruction-lights and the subject invention substantially fills that need. There are additional industrial and vehicular warning light applications that can benefit from the LED array warning light invention.

While these devices fulfill their respective, particular objectives and requirements, the aforementioned patents do not describe an LED array warning light system that allows rendering towers, cables and tall buildings visible to approaching aircraft.

In this respect, the TED array warning light system according to the present invention substantially departs from the conventional concepts and designs of the prior art, and in doing so provides an apparatus primarily developed for the purpose of rendering towers, cables and tall buildings visible to approaching aircraft.

Therefore, it can be appreciated that there exists a continuing need for a new and improved LED array warning light system which can be used for rendering towers, cables and tall buildings visible to approaching aircraft. In this regard, the present invention substantially fulfills this need.

SUMMARY OF THE INVENTION

In view of the foregoing disadvantages inherent in the known types of lighting systems of known designs and configurations now present in the prior art, the present invention provides an improved LED array warning light system. As such, the general purpose of the present invention, which will be described subsequently in greater detail, is to provide a new and improved LED array warning light system and method which has all the advantages of the prior art and none of the disadvantages.

To attain this, the present invention essentially comprises fifteen elongated plate-like struts 24 vertically aligned in a generally conical configuration. Each strut has a short horizontal upper edge and a parallel short horizontal lower edge. Each strut also has a long inner edge and a parallel long outer edge. Next-provided are six light emitting diodes (LED's). Each diode has an external light emitting portion and an internal non-light emitting portion, each affixed one above the other to the outer edge of each strut. A horizontal small top disk is next provided. The top disk has a centrally disposed vertical axis. The top disk also has fifteen radial slots. Each slot receives and is affixed to an upper edge of an associated strut. Also provided is a horizontal large bottom disk. The bottom disk has a centrally disposed vertical axis. The bottom disk also has fifteen radial slots. Each slot receives and is affixed to a lower edge of an associated strut. The axes of each associated top and bottom disk are a common vertical axis. The disks are sized whereby the LED's are at an angle of between 3 and 25 degrees, preferably 10 degrees, from the common vertical axis. Next provided is an array base. The array base has a lower face and an upper circular face receiving and supporting the bottom disk and struts, top disk and LED's. The struts, disks and LED's constitute a light source array. A threaded attachment is provided. The threaded attachment depends downwardly from the lower face of the array base. The disks and struts are fabricated from electrically insulating material with a thermally insulating layer and with electrically conductive lines for conducting power to the LED's. Next provided is a base. The base has a threaded internal socket. The internal socket has electrically conductive portions for receiving the threaded attachment and the passage of electrical energy from a remote power source to the LED's. Lastly, a translucent dome is provided. The dome is supported by the base with an open top for the dissipation of heat and with a lenticular array to provide azimuthal spread.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved LED array warning light system which has all of the advantages of the prior art lighting systems of known designs and configurations and none of the disadvantages.

It is another object of the present invention to provide a new and improved LED array warning light system which may be easily and efficiently manufactured and marketed.

It is further object of the present invention to provide a new and improved LED array warning light system which is of durable and reliable constructions.

An even further object of the present invention is to provide a new and improved LED array warning light system which is susceptible of a low cost of manufacture with regard to both materials and labor, and which accordingly is then susceptible of low prices of sale to the consuming public, thereby making such LED array warning light system economically available to the buying public.

Even still another object of the present invention is to provide an LED array warning light system for rendering towers, cables and tall buildings visible to approaching aircraft.

Lastly, it is an object of the present invention to provide a new and improved LED array warning fight system comprising a plurality of struts in a generally conical configuration. Each strut has an upper and lower edge and an inner and an outer edge. A plurality of light emitting diodes are affixed one above the other to an edge of each strut. A top disk with radial slots receives and is affixed to an upper edge of an associated strut. A bottom disk has radial slots which receive and are affixed to a lower edge of an associated strut. The disks are sized whereby the LED's are at an angle of between 3 and 25 from the axis These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompany-ng drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
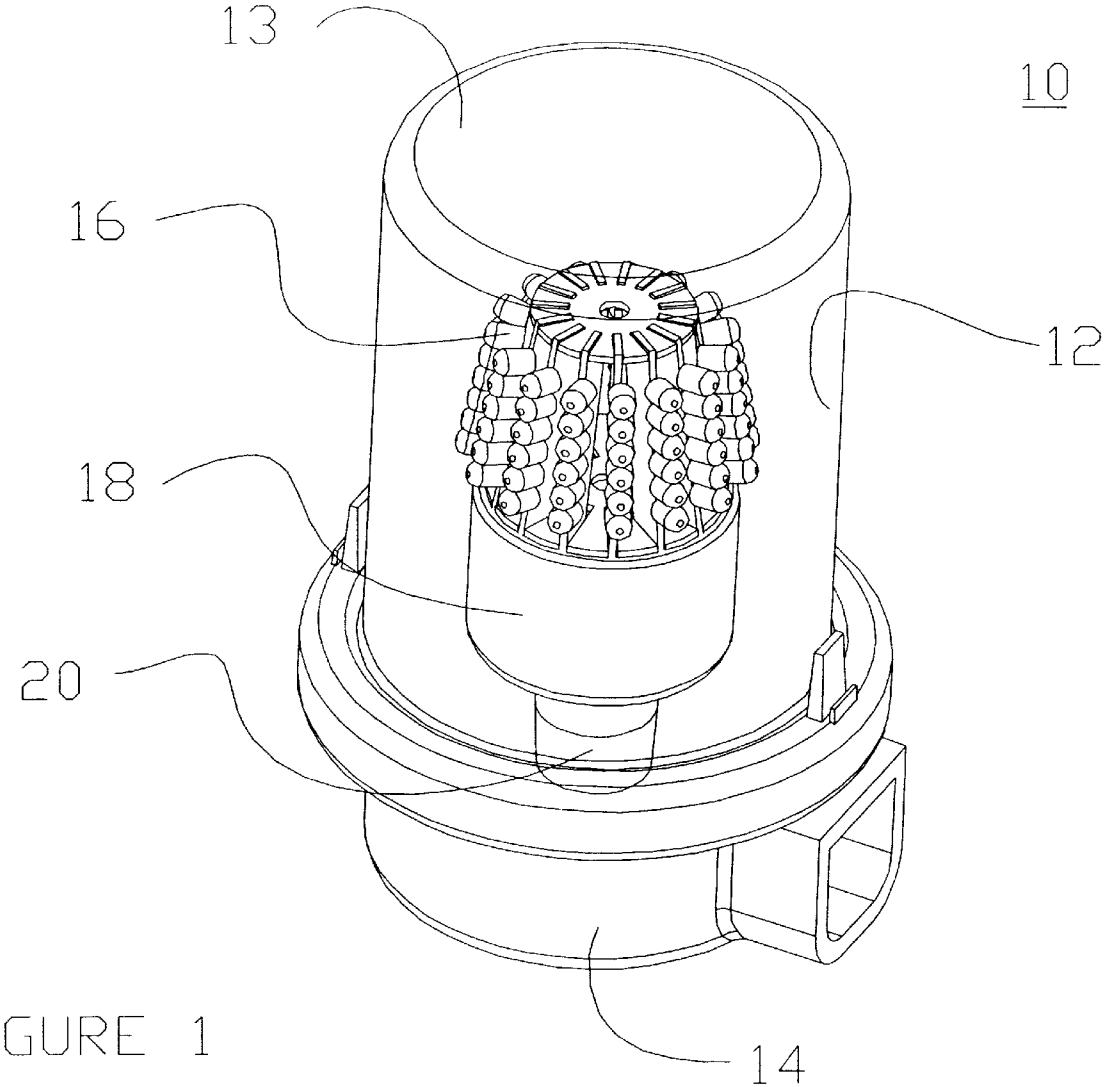
FIG. 1 is a perspective illustration of the LED array warning light system constructed in accordance with the principles of the present invention.
Figure 2:
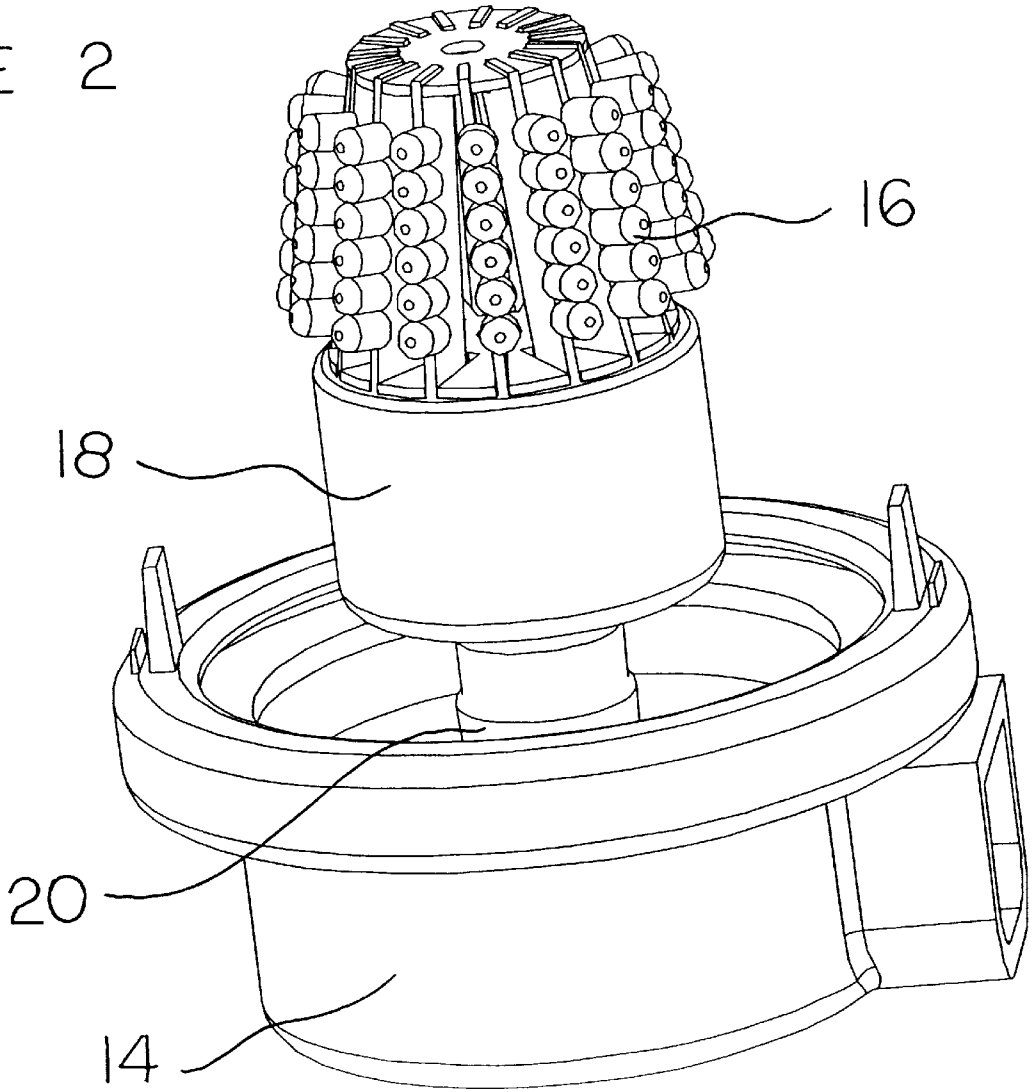
FIG. 2 is a perspective illustration similar to FIG. 1 but with the dome removed.
Figure 3:
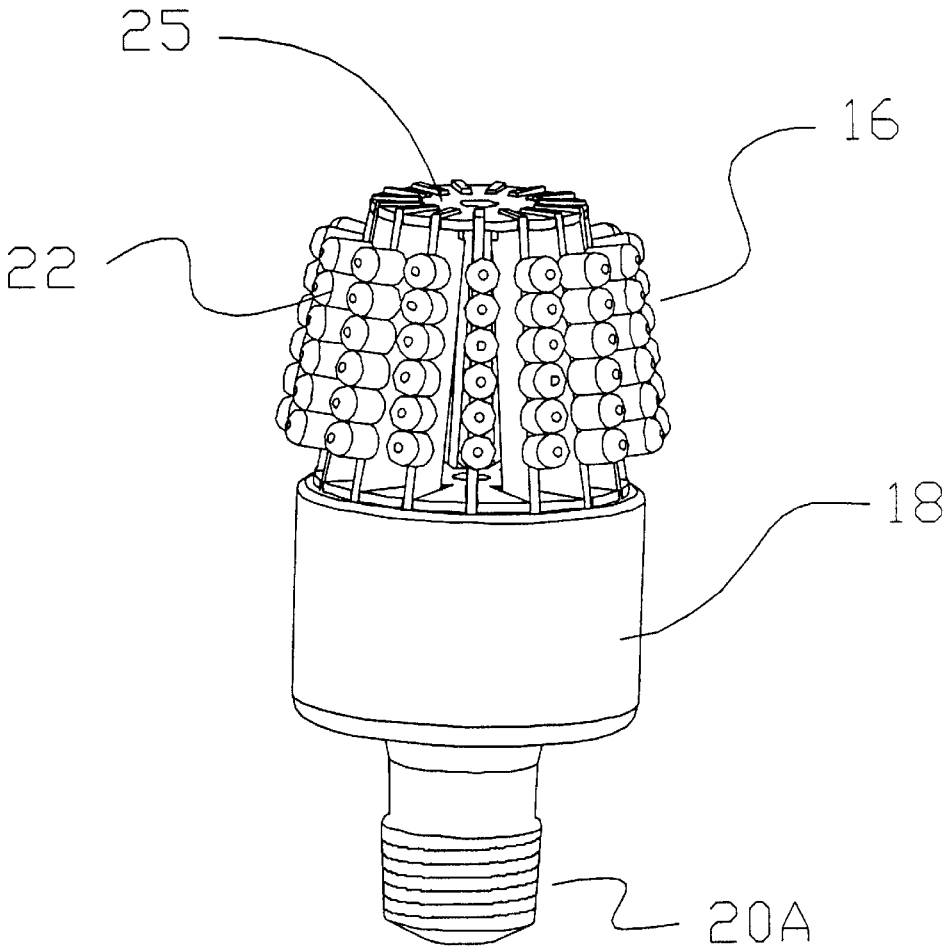
FIG. 3 is a perspective illustration similar to FIG. 2 but with th base removed.

With reference now to the drawings, and in particular to FIG. 1 thereof, the preferred embodiment of the new and improved LED array warning light system embodying the principles and concepts of the present invention and generally designated by the reference numeral 10 will be described.

The present invention, the LED array warning light system 10 is comprised of a plurality of components. Such components in their broadest context include a plurality of struts, a plurality of light emitting diodes, a top disk and a bottom disk. Such components are individually configured and correlated with respect to each other so as to attain the desired objective.

First provided are fifteen elongated plate-like struts 24 vertically aligned in a generally conical configuration. Each strut has a short horizontal upper edge and a parallel short horizontal lower edge. Each strut also has a long inner edge and a parallel long outer edge.

Next provided are six light emitting diodes (LED's) 22. Each diode has an external light emitting portion and an internal non-light emitting portion, each affixed one above the other to the outer edge of each strut.

A horizontal small top disk 25 is next provided. The top disk has a centrally disposed vertical axis. The top disk also has fifteen radial slots. Each slot receives and is affixed to an upper edge of an associated strut.

Also provided is a horizontal large bottom disk 27. The bottom disk has a centrally disposed vertical axis. The bottom disk also has fifteen radial slots. Each slot receives and is affixed to a lower edge of an associated strut. The axes of each associated top and bottom disk are a common vertical axis. The disks are sized whereby the LED's are at an angle of between 3 and 25 degrees, preferably 10 degrees, from the common vertical axis.

Next provided is an array base 18. The array base has a lower face and an upper circular face receiving and supporting the bottom disk and struts, top disk and LED's. The struts, disks and LED's constitute a light source array 16.

A threaded attachment 20A is provided. The threaded attachment depends downwardly from the lower face of the array base.

The disks and struts are fabricated from electrically insulating material with a thermally insulating layer and with electrically conductive lines for conducting power to the LED's.

Next provided is a base 14. The base has a threaded internal socket 20. The internal socket has electrically conductive portions for receiving the threaded attachment and the passage of electrical energy from a remote power source to the LED's.

Lastly, a translucent dome 12 is provided. The dome is supported by the base with an open top for the dissipation of hear and with a lenticular array 13 to provide azimuthal spread.

An LED array warning light 10 comprising a translucent dome 12 possibly with an interior lenticular array 13, a fixture base 14, Tight Emitting Diode (LED) light source array 16, an array base 18, and an internal socket 20. See FIGS. 1, 2, 3, 4, 5, 6, 7 and 8. LED light source array 16 comprises a plurality of LEDs 22 affixed to a plurality of vertical struts 24, top disk 25, bottom disk 27, and array base 18 which houses the requisite electrical wiring and electronic devices necessary to produce stable light emission from LEDs 16. Internal socket 20 permits threaded attachment 20A of array 16 to fixture base 14, and electrical connection to external power. There are several possible electrical configurations ranging from having all LEDs 16 in series connection to having all LED's 16 in parallel connection. Ideally, all LEDs 16 in a series connection is recommended since the failure of one LED 22 in the array is currently required to produce a detectable failure of the entire array. Gasket 28 provides an environmental seal for the interface of the fixture base 14 and the dome 12. The warning light is generally required to produce red color for aircraft obstruction applications, however other applications, such as airport taxiway lighting or industrial warning, may require blue, green, or amber colors. Colored LEDs are preferred to form the array 16 and the dome 12 may be either clear or tinted as desired. Dome 12 may have an internal or external lenticular array feature 13, which serves to provide azimuthal integration of the emitted light beam thereby eliminating "hot spots" or "dead zones" in a 360-degree band around the light.

Figure 4:
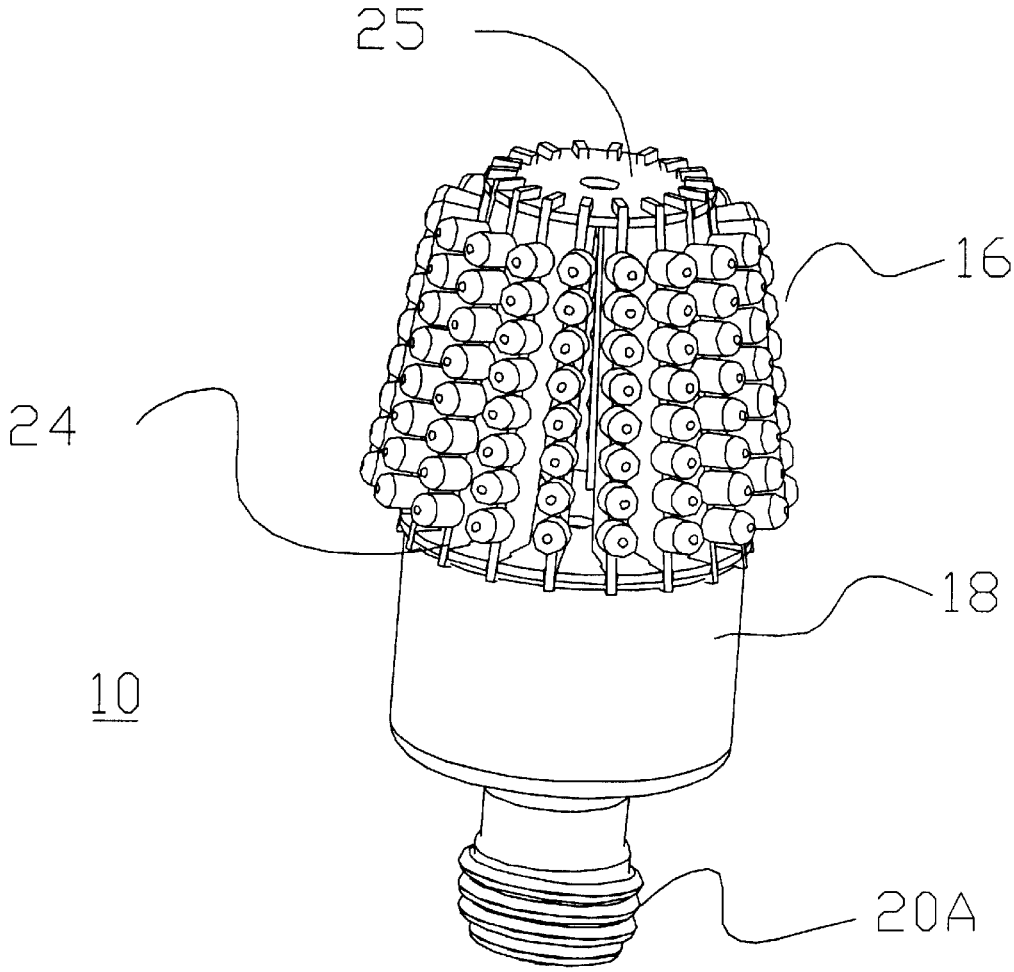
FIG. 4 is a perspective illustration similar to FIG. 3 showing an alternate embodiment of the invention.
Figure 5:
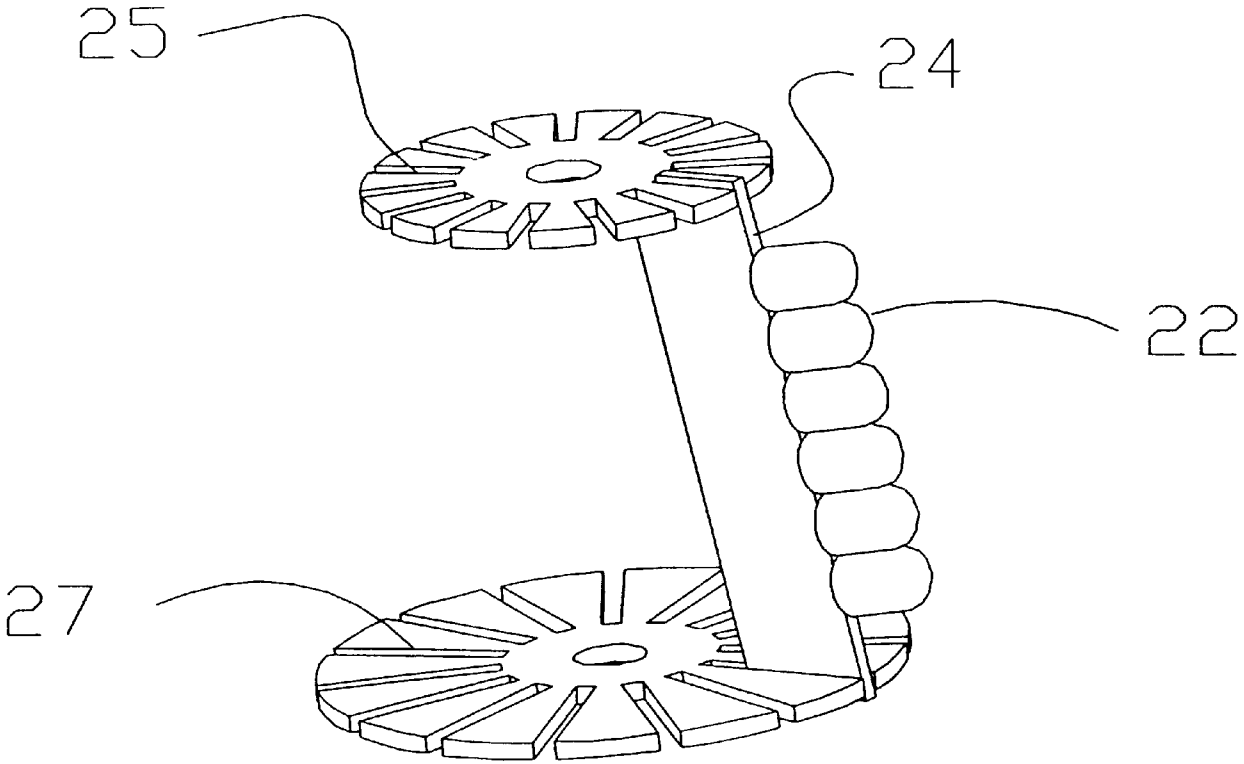
FIG. 5 is a perspective illustration of the top and bottom disks and with one strut and LED's.
Figure 6:
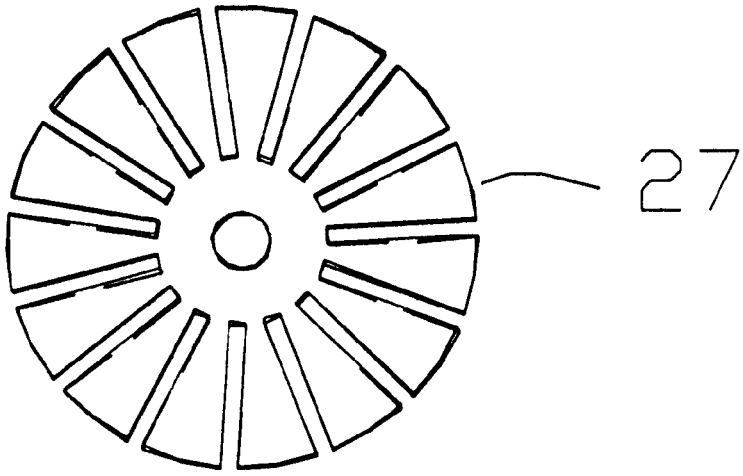
FIG. 6 is a top plan view of the bottom disk with the struts removed.
Figure 7:
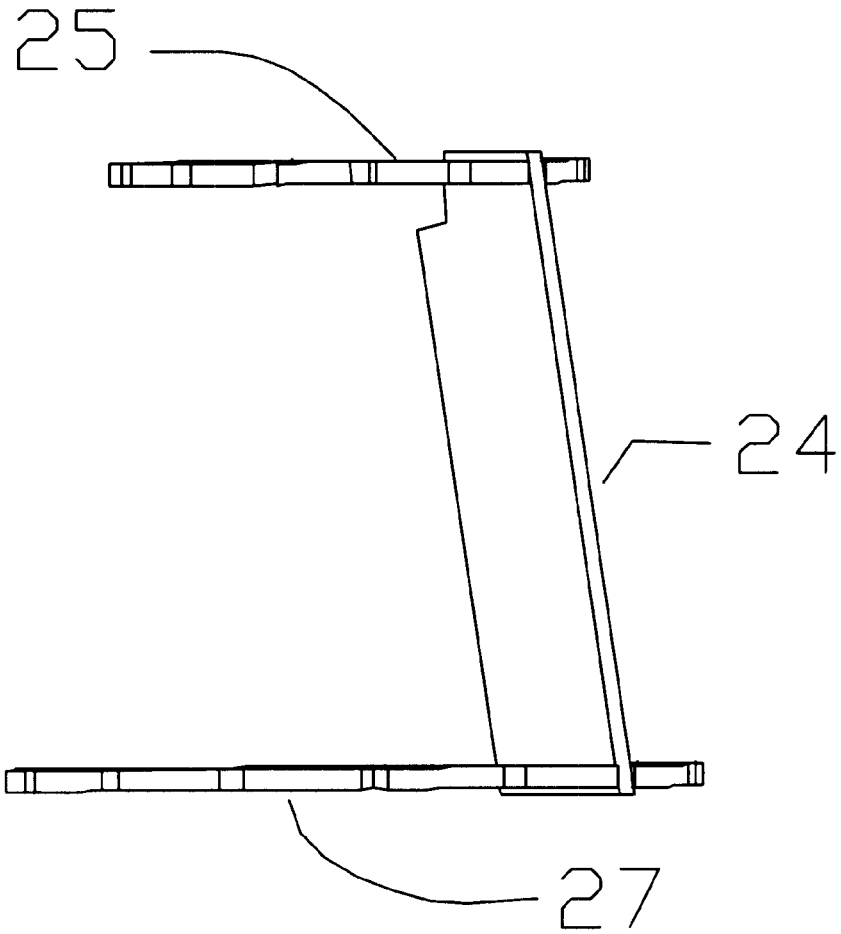
FIG. 7 is a respective illustration of the top and bottom disks and with one strut.

In the particular L810 application modeling and experimental studies demonstrated that an array having nine LEDs 22 affixed to each of 18 struts 24, shown in FIG. 4, will produce the required output if LEDs 22 are minimal 15 degree, 4 candela, 630 nm wavelength versions such as the Sunled LZE12W, operated at 40 milliamps. The number of LED's and struts will be reduced as higher power, larger angle LED's become avialable. The LEDs 22 are obtained as 5 mm diameter cylinders having a rounded lensed emitting end and a flattened flanged base end having two electrical leads emerging therefrom. LEDs 22 are soldered to a printed circuit formed on strut 24 so that their base end having emergent electrical leads abuts an edge of strut 24 thereby providing simplistic alignment with the strut 24 edge. Most of the heat generated during TED operation is conducted through the connecting leads to the powering circuitry and is further transferred to the environment by convection from struts 24. Struts 24 have successfully been fabricated from copper clad glass printed circuit board material type FR4 of 0.062-inch thickness and clad with 2 ounce copper. The copper was etched to form a typical printed circuit thereby permitting solder attachment of the LEDs 22 directly to the strut 24. Strut 24 having 9 LEDs 22 affixed thereto is affixed to the top disk 25 and bottom disk 27 by soldering. Top disk 25 and bottom disk 27 have slots formed therein and also comprise a copper clad glass printed circuit structure having circuitry thereon to provide power to struts solderably affixed thereto. Struts 24 are caused to engage these slots and held by soldering, welding, or using a conducting adhesive. In the special case of the aircraft obstruction light, top disk 25 is of a smaller diameter than bottom disk 27 therefore strut 24 will not be in alignment with the central coaxially oriented axes of disk 25 and disk 27. To produce upwardly directed light the top disk must be of smaller diameter than the lower disk enabling struts 24 to lean inward toward the axis of disks 24 and 27, or slots engaging struts 24 formed in the top disk must be cut more deeply to achieve the same effect. The acute angle which strut 24 makes with the disk axes will be the angle at which light is emitted above horizontal, therefore a nominal 10 degree angle will satisfy the FAA requirement of 4–20 degrees elevation. In Canada and countries using ICAO rules there is a requirement for a percentage of light to travel in a vertical direction. Vertical light output is obtainable by affixing a plurality of LEDs to the top disk 25. The present model employs six LEDs to achieve vertical output. In an alternate embodiment a ring-like reflector is disposed outside the bottom row of LEDs wherein the reflector directs a portion of light emitted from this row in an upward direction. In another alternate embodiment a plurality of LEDs in any row are angled upward to produce vertical ouput as required to meet specifications. Struts 24 may be cut to accommodate these upwardly directed LEDs and provide simplified alignment.

Figure 8:
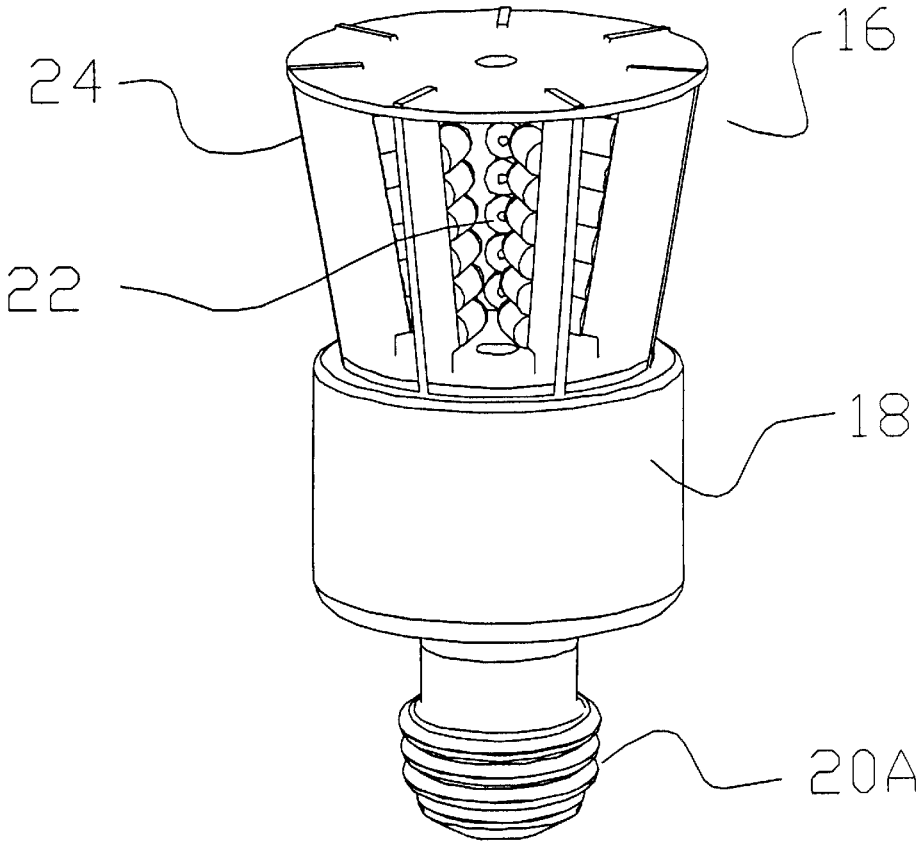
FIG. 8 is a perspective illustration of the LED array having inwardly pointing LED's.

An interesting alternate embodiment of the LED array warning light 10 shown in FIG. 8 is obtained by facing the LEDs inward toward the disk axes so that emitted light from a column of LEDs passes substantially between a strut pair on the opposite side of the light. LEDs generally emit light in a cone of well-defined half intensity angle and for uniform light distributions the output should overlap at this angle. Staggering or increasing strut spacing will prevent beam clipping by led bodies on opposing struts. LEDs facing inward achieve higher degrees of beam overlap than those facing outward and beam uniformity is improved as well as increased output associated with reduction of LED half intensity angle by using this arrangement. Also, the LED is minimally exposed to mechanical damage and this arrangement permits introduction of a simplified, aesthetically pleasing dome, if desired. This conceptual portion of the disclosure was realized in generation of this document and is verified by computer modeling.

LEDs are susceptible to degradation or failure by thermal mechanism and care must be taken to remove heat from any LED. At lower heating values the LED output wavelength shifts thereby changing the color to potentially undesirable values. At high heat levels catastrophic failure will occur within a relatively short time period seriously affecting longevity in a practical system. The LED array warning light 10 is devised to incorporate an innovative heat transfer method provided by the heat dissipative properties of vertical struts 24. In one embodiment, struts 24 comprise conventional copper clad glass printed circuit board having LEDs 22 soldered thereto. Heat from the LEDs is conducted through the LED leads and solder to the printed circuit board copper. The heat is further transferred to the surrounding air by convection. The plurality of struts 24 convectively removes heat from the LEDs thereby permitting LEDs 22 to operate within their rated specifications. In another embodiment the printed circuit boards forming struts 24 comprise an aluminum base plate with attached thin layer insulation and copper cladding portions. Materials such as commercially available Ormet circuit boards are based on an anodized aluminum substrate well adapted for this application. Heat transfer may also be further promoted by elimination of a covering protective dome in this robust design. Elimination of a dome permits air circulation and communication of heat to the environment without restriction to the confined air space separating the array from the dome. The general design of the LED array warning light 10 is sufficiently robust to survive most environments and devices such as a spike-like ice-breaking shield may be easily built into light 10 to mitigate damage from falling ice in aircraft obstruction installations. A non-occluding screen cover may also be employed to preclude insect and bird nesting within the free space of the array.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An LED array warning light system for rendering towers, cables and tall buildings visible to approaching aircraft, comprising, in combination:

fifteen elongated plate-like struts vertically aligned in a generally conical configuration, each strut having a short horizontal upper edge and a parallel short horizontal lower edge and with a long inner edge and a parallel long outer edge;

six light emitting diodes arrays, each LED with an external light emitting portion and an internal non-light emitting portion, each affixed one above the other to the outer edge of each strut;

a horizontal small too disk having a centrally disposed vertical axis, the top disk having fifteen radial slots, each slot receiving and affixed to an upper edge of an associated strut;

a horizontal large bottom disk having a centrally disposed vertical axis, the bottom disk having fifteen radial slots, each slot receiving and affixed to a lower edge of an associated strut, the axes of said top and bottom disk being a common vertical axis, the disk's being sized whereby the LED's are at an angle of between 3 and 25 degrees, preferably 10 degrees, from the common vertical axis;

an array base having a lower face and an upper circular face receiving and supporting the bottom disk and struts, top disk and LED's; the struts, disks and LED's constituting a light source array;

a threaded attachment depending on a downwardly from the lower face of the array base;

the disks and struts being fabricated from electrically insulating material with a thermally insulating layer and with electrically conductive lines for conducting power to the LED's;

a base with a threaded internal socket having electrically conductive portions for receiving the threaded attachment and the passage of electrical energy from a remote power source to the LED's; and a translucent dome supported by the base with an open too for the dissipation of heat and with a lenticular array to provide azimuthal spread.

2. An LED array warning light system comprising:

a plurality of struts in a generally conical configuration, each strut having an upper and lower edge and with a inner and an outer edge;

a plurality of light emitting diodes affixed one above the other to an edge of each strut whereby the light emitting diodes may be viewed for 360 degrees;

a top disk with radial slots for receiving and affixed to an upper edge of an associated strut; and a bottom disk with radial slots for receiving and affixed to a lower edge of an associated strut, the disks being sized whereby the LED's are at an angle of between 3 and 25 degrees from the axis.

3. The system as set forth in claim 2 and further including an array base having a lower face and an upper circular face receiving and supporting the bottom disk and struts, top disk and LED's, the struts, disks and LED's constituting a light source array.

4. The system as set forth in claim 3 and further including a threaded attachment depending downwardly from the lower face of the array base.

5. The system as set forth in claim 2 and wherein the disks and struts being fabricated from electrically insulating material wish a thermally insulating layer and with electrically conductive lines for conducting power to the LED's.

6. The system as set forth in claim 2 and further including a base with a threaded internal socket having electrically conductive portions for receiving the threaded attachment and the passage of electrical energy from a remote power source to the LED's.

7. The system as set forth in claim 6 and further including a translucent dome supported by the base with an open top for the dissipation of heat and with a lenticular array to provide azimuthal spread.

8. The system as set forth in claim 2 and wherein the LED's are along the exterior edge.

9. The system as set forth in claim 2 and wherein the LED's are along the interior edge.

* * * * *